United States Patent [19]

Richardson

[11] 4,375,875

[45] Mar. 8, 1983

[54] CRADLE FOR A TWISTING MACHINE

[75] Inventor: Walter L. Richardson, Pointe Claire, Canada

[73] Assignee: Northern Telecom Limited, Montreal, Canada

[21] Appl. No.: 275,302

[22] Filed: Jun. 19, 1981

[51] Int. Cl.[3] ..... B65H 59/06

[52] U.S. Cl. ..... 242/156.2; 57/58.52; 57/127.5; 57/127.7

[58] Field of Search ..... 242/156.2, 156, 45, 242/75.43, 75.44, 75.4, 129.8; 57/58.52, 58.54, 58.55, 58.57, 58.49, 58.7, 58.72, 58.86, 127.5, 127.7; 188/71.1, 72.1, 72.9, 166

[56] References Cited

U.S. PATENT DOCUMENTS 1,671,976 6/1928 Avery ..... 242/156.2
2,277,102 3/1942 Henning et al. ..... 242/156.2 X
3,465,981 9/1969 Byrt ..... 242/156.2 X

FOREIGN PATENT DOCUMENTS 45759 11/1966 Fed. Rep. of Germany ..... 242/156
563751 6/1957 Italy ..... 242/156.2
889689 2/1962 United Kingdom ..... 242/156.2

*Primary Examiner*—Stanley N. Gilreath
*Attorney, Agent, or Firm*—R. J. Austin

[57] ABSTRACT

Cradle for a twisting machine having a tensioning device with a brake disc coaxial with and rotatable with the reel shaft, while being axially immovable, and two opposed brake pads disposed on each side of the disc at one location. A brake actuator is controlled by movement of a tensioning pulley when material is fed from a reel under tension, to move the brake pads away from each other controllably so as to release the braking force in positive fashion.

14 Claims, 7 Drawing Figures

CRADLE FOR A TWISTING MACHINE

This invention relates to cradles for twisting machines for filamentary material.

High speed twisting machines are known for twisting together two lengths of filamentary materials, e.g. insulated telecommunications conductors. In one form of twisting machine for twisting two conductors into a twisted pair with conductors of, for instance 22, 24 or 26 AWG, the two lengths of insulated conductors are held upon reels (referred to as "half" reels) which are freely rotatably mounted upon reel shafts upon opposite sides of a cradle. To twist the lengths of conductor together, each length is fed from its half reel, around a rotatable pulley held with its axis stationary relative to the axes of the reel shafts, and then around a tensioning pulley. The two lengths then are brought to side-by-side positions in which they pass downwardly from the cradle under a pulley, and then upwardly along a curved flyer bar which rotates about a vertical axis and its sweep encompasses a space containing the two half reels. By this means, the conductor lengths receive a double twist, e.g. at a flyer speed of 1200 r.p.m., the conductors having 2400 twists per minute.

The tension pulley for each half reel is mounted at one end of an arm which is pivotally mounted concentrically with the half reel. A disc brake arrangement is employed to maintain predetermined tension in the conductor length being drawn from the half reel and around the tensioning pulley. In general terms, when the conductor length is under tension, the pulley and arm are pivotted downwards to release the brake and reduce the resistance to rotation of the half reel and, when tension is relaxed, the arm is pivoted upwards under spring pressure to apply the brake. In greater detail, a torsion spring is concentrically arranged with the arm and half reel spindle and in a normal spring position, the disc brake is held engaged to prevent rotation of the spindle. Concentrically within the spring is a ball race with helical tracks for the balls. Upon the pulley and arm being moved downwards, the spring is torsioned to rotate the outer housing of the race which moves the outer housing axially by virtue of the movement of the balls along their helical tracks. This axial movement of the housing removes an axial end load upon the components of the disc brake whereby braking pressure is removed.

Although the above cradle design suffers from various disadvantages, it has been used continually in high speed twisting machines for about fifty years, and no design has been successfully introduced to avoid these disadvantages. One problem concerns the brake itself. The brake comprises three concentric disks, an intermediate disc which is drivably connected to the half reel spindle and two outer discs both of which are drivably connected to the outer housing of the ball race. The discs are drivably connected to their respective carrying means by the reception of driving projections in axial grooves which allow for axial movement of all of the discs during application and release of the braking force. A problem with this design is that the driving projections are subject to minute fractures which tend to erode the positive drive connection between projections and grooves and this impedes correct brake action as dictated by the pivotal position of the arm. Hence, frequent brake adjustment and maintenance is necessary. Further, errosion occurs between ball contact points and the tracks of the inner and outer housing of the ball race and it is believed that this is due to vibration and impact during use. The clearance between the race parts is thus increased to result in more rapid wear and lessening positive relationship between the torsion spring position, the braking force applied and the wire tension. Further to this, while the braking force is applied positively, no means is provided to positively separate the brake discs upon relaxation of the braking force. In consequence, the brake surfaces need not disengage when required to do so and consequent slippage of those surfaces increases the wear.

Apart from the fact that maintenance of the above cradle design is costly, the uneven tension control of each conductor length as it is fed from its half reel and is twisted results in excessive mutual capacitance between conductors, increased conductor resistance and capacitance and resistance imbalance. Hence, wear in the cradle leads to twisted conductor pairs with electrical properties which depart from those desired.

Further to the above, the conventional cradle design is exceedingly heavy for the tasks it needs to perform. The concentrically mounted parts rotatably mounted around the shaft, which include the arm, the torsion spring and helically tracked race, have a total weight above 9.5 lbs. This weight needs to be rotated every time wire tension is adjusted and its moment of inertia is approximately 144.5 lbs.ins.$^2$. Whenever the period for each revolution of a half reel matches the natural period of oscillation of the arm, substantial oscillation of the arm can result and deliver undue tension peaks into a conductor length.

Clearly, a different design of cradle is required to avoid the use of the torsion spring and the three brake discs, each of which is axially movable and so overcome all of the above problems.

According to the present invention, there is provided a cradle for a twisting machine for filamentary material comprising a reel shaft for a half reel of filamentary material and rotatably mounted upon a support, and a tensioning device for the material, the tensioning device comprising a brake disc coaxial with and rotatable together with the reel shaft and axially immovable relative to the shaft, two opposed brake pads disposed one on each side of the disc and located in position radially outwards on one side of the axis of the reel shaft, a rotatable tensioning pulley having biasing means to urge the wheel with its rotational axis in one direction of movement and being movable in an opposite direction by a force acting against the biasing means, and a brake actuator comprising a pad moving means on said one side of the axis of the reel shaft and an operating means controlled by movement of the pulley in said one direction to operate the moving means to move the pads controllably towards each other and apply a braking force to the disc, said force being dependent upon the position of the pulley, and to move the pads controllably away from each other and reduce the braking force upon movement of the pulley in said opposite direction.

With constructions coming within the scope of the invention, the use of a concentric torsion spring and ball race with helical tracks to remove braking pressure is avoided. Furthermore, the operating means ensures that the positions of the brake pads are controlled at all times and not merely during application of the brake as with conventional cradle. The operating means according to the cradle of the invention is able to control the brake pad position because the positioning of the brake pads and pad moving means to one side of the axis of the reel shaft avoids the concentric arrangement together with its restrictions on the control of the brake pads. Hence, these parts are easily accessible to enable a positive positional control on the pads to be provided.

In a preferred arrangement which is simple in design, the pad moving means comprises two brake arms which are pivotally connected together at a point of connection. These arms extend from the point of connection, one on each side of the brake disc with the pads mounted one upon each of the arms. The arms are pivotally movable at their point of connection to move the pads towards one another and away from one another.

As may be seen from the above, with the use of the pads moving means and the arms, these elements are not rotatable and do not add to the inertia of the parts which need to be rotated to apply or remove the braking force.

One embodiment of the invention will now be described, by way of example, with reference to the accompanying drawings in which.

Figure 1:
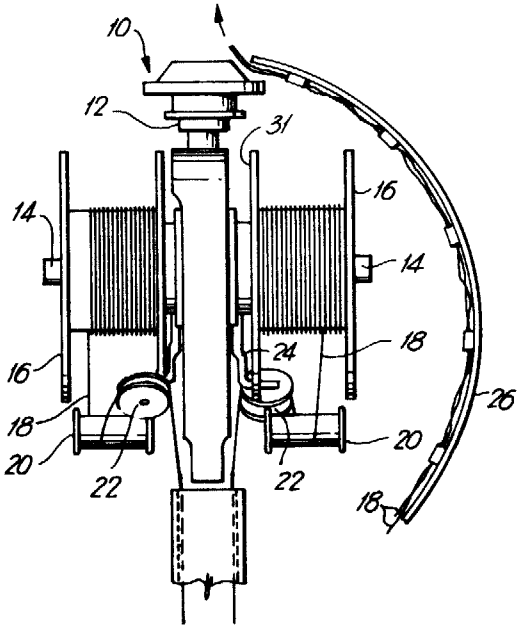
FIG. 1 is a simplified front view of a cradle of a high speed twister showing half reels in position.

In a high speed twisting machine for twisting two lengths of insulated telecommunications conductor into a twisted pair, there is provided a cradle 10 which is basically as shown in FIG. 1. FIG. 1 shows that the cradle is of the same fundamental design as conventional cradles in that it comprises a central support pedestal 12 having horizontally opposed and in-line half reel shafts 14 for carrying half reels 16 each of which is wound with an indefinite length of insulated conductor 18. Each length 18 is fed from its reel, around a horizontal pulley 20 and then around a tensioning pulley 22 before passing downwardly through a central passage in the cradle. The two lengths pass under a pulley (not shown) located at the flyer bar entrance and then proceed up a flyer bar 26 which is rotating about the vertical axis of the pedestal with its sweep encompassing a space containing the pedestal and the two half reels. The twisted together lengths proceed upwardly from the cradle around a capstan (not shown) which controls the throughout speed, and finally are wound onto a full reel (not shown).

It is an essential feature of twisting machines that tension is maintained between predetermined limits in the conductor lengths as they are drawn from their half reels. To this end, a brake is normally applied to resist rotation of the half reels, and the braking force is reduced to each reel shaft when its associated conductor length is tensioned sufficiently to pull the tensioning pulley 22 downwards. The pulley is mounted upon one end of a brake release arm 24, which is pivoted concentrically with the reel shaft and downward pivoting movemnt of the arm operates to release the brake.

The present invention, as is shown by this embodiment, differs from the conventional cradle in the tensioning device used to maintain the desired tension in each conductor length.

Figure 2:
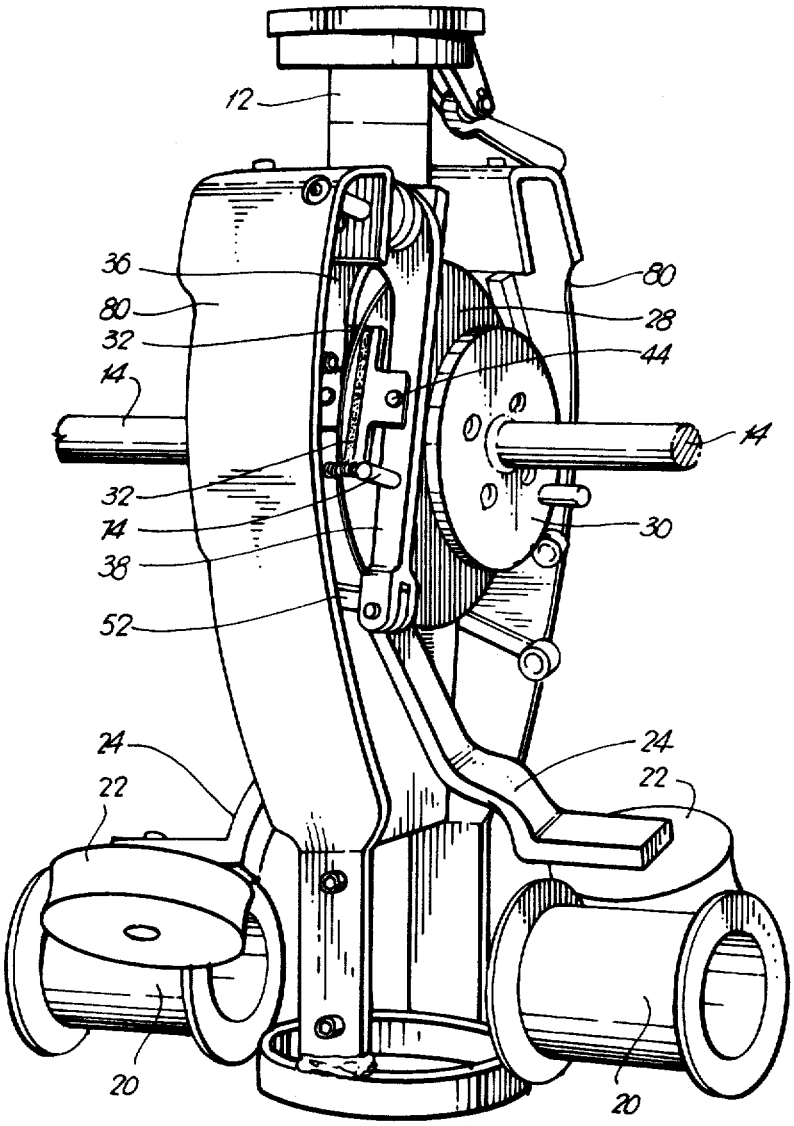
FIG. 2 is a part side elevational isometric view of the cradle with half reels removed.

The tensioning device of the embodiment is most clearly shown by FIGS. 3 to 7 but also with reference to FIG. 2 which shows the relationship in the various features.

Figure 4:
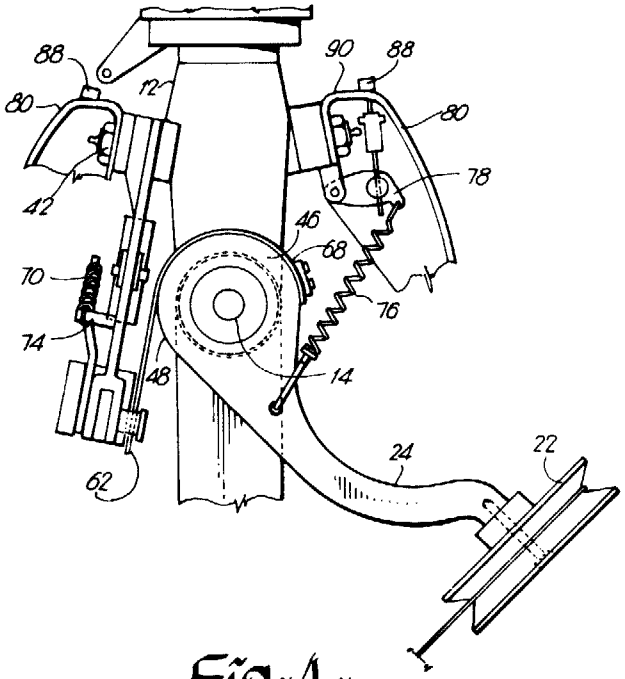
FIG. 4 is a side view of part of the cradle as in FIG. 3 and with a half reel brake disc and back plate removed.
Figure 3:
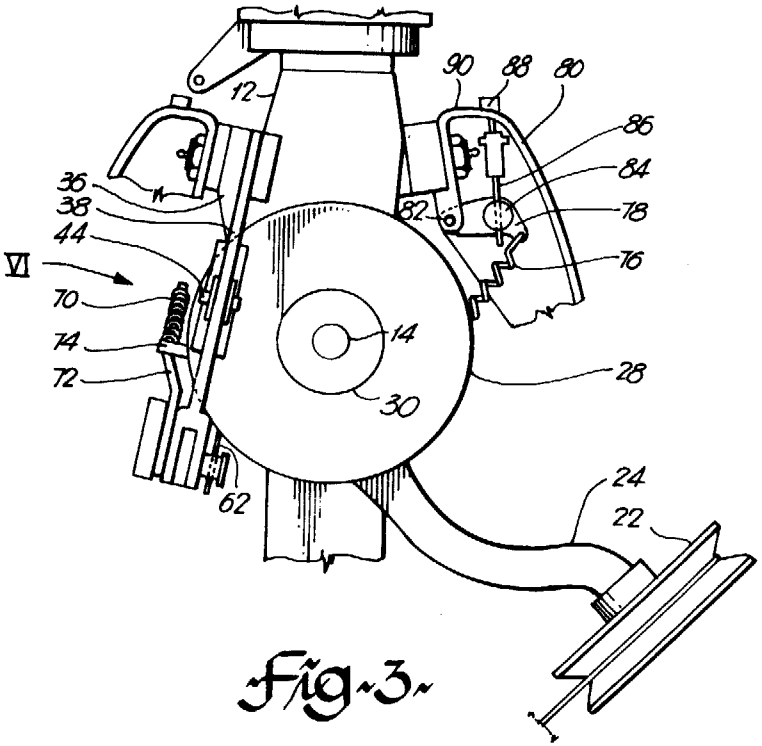
FIG. 3 is a side view of part of the cradle.
Figure 5:
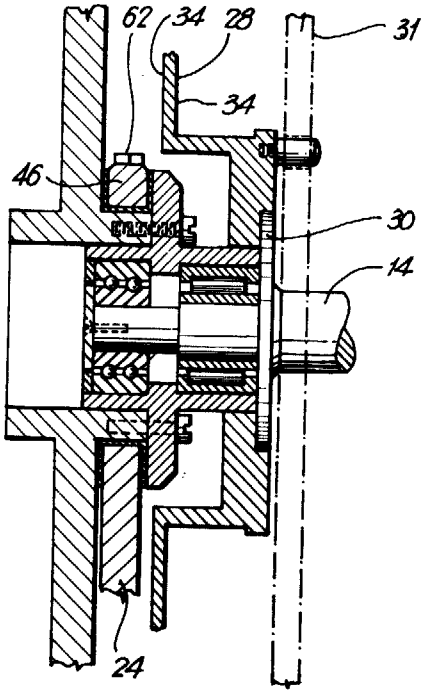
FIG. 5 is an axial cross-sectional view through part of the reel shaft mounting on the cradle.

As shown by FIGS. 2, 3 and 4, a brake disc 28 is held coaxially upon each reel shaft 14 by being secured to a flange 30 of the shaft. Mounted upon the shaft is also a back plate 31 for the half reel (FIG. 5).

Apart from the brake disc, the tensioning device associated with each reel shaft comprises two opposed brake pads 32 disposed one on each side of the disc (FIGS. 6 and 7) for applying braking force against the surfaces 34 of the brake disc. As is clear from the Figures, the pads are located in a position radially outwards on one side of the axis of the reel shaft.

A brake actuator is provided for moving the pads. This actuator comprises two brake arms 36 and 38 pivotally connected together at a point of connection 40, the arms thereby forming a caliper and extending across the brake disc, one at each side. The arms 36 and 38 are mounted by a pivot pin 42 at connection point 40 to the pedestal 12. At positions intermediate the ends of the arms 36, 38, the brake pads 32 are mounted by pivotal connections 44, thus enabling the pads to swivel and position themselves automatically against the surfaces 34 of the brake disc when a braking force is applied.

FIGS. 3 and 4 show that each pulley 22 is rotatably mounted at the end of its release arm which extends outwardly of the reel shaft axis from an internal brake release actuator 46 which is pivotally mounted upon the support pedestal 12 concentrically with the reel shaft. Apart from the position at which the release arm is joined to the actuator, the outer surface 48 of the actuator is arcuate, i.e. it is part circular with a centre coincident with the reel shaft axis (FIG. 4).

Figure 6:
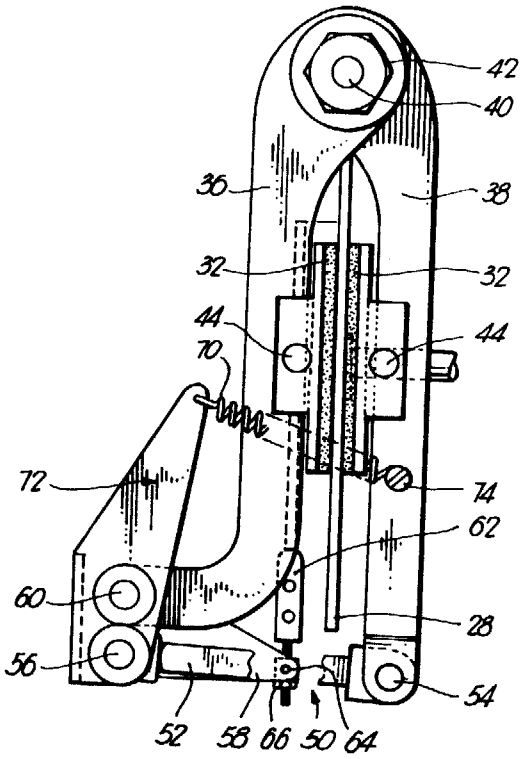
FIG. 6 is a view of part of the cradle taken in direction of arrow VI in FIG. 3 and showing the braking force applied.
Figure 7:
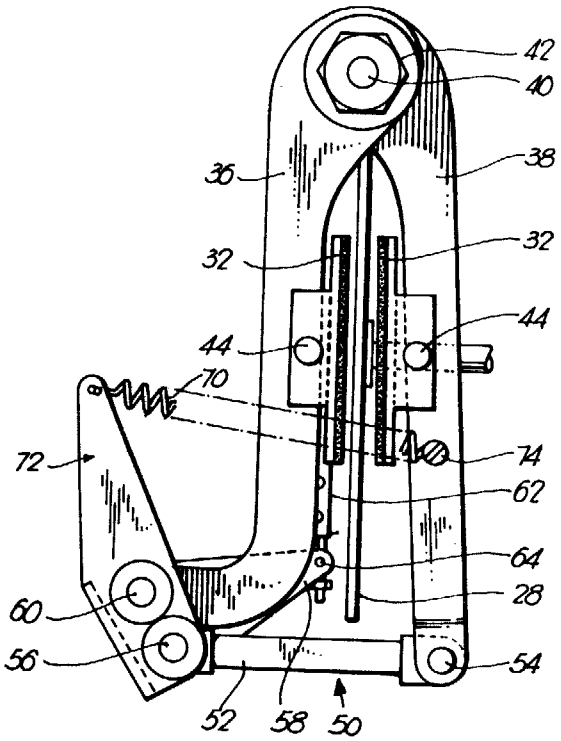
FIG. 7 is a view similar to FIG. 6 with the braking force removed.

The brake actuator also comprises an operating means controlled by movement of each pulley 22 to operate the arms 36, 38 to move the pads controllably towards or away from each other. This operating means comprises, in respect of each reel shaft, a brake release linkage 50 (FIGS. 6 and 7) pivotally connected to the two arms. This linkage includes a link 52 pivotally connected at position 54 to arm 38, the link extending across the plane of, but outwardly from the brake disc 28 and pivotally attached at position 56 to an actuating lever 58 of the operating means. The lever 58 is pivotally attached to the free end of the arm 36 at position 60. With the braking force applied, as shown in FIG. 6, with the brake pads engaging the surfaces 34 of the disc 28, a common plane passing through the axes of the pivotal positions 54 and 60, lies at an angle to a plane normal to the plane of the disc 28. To release the brake or reduce the braking force, it is necessary to relatively pivot the arms 36, 38 apart and this is effected by pivoting the lever 58 about position 56 to move the positions 54 and 60 further apart and their common plane more towards a position normal to the disc plane. A brake release position is shown by FIG. 7.

To open the arms 36, 38 a brake release connector is provided. This consists of a high tensile steel ribbon 62. This ribbon is attached at one end to a third pivotal position 64 of the lever 58 by means of an adjustable screw-threaded adjuster device 66 which is adjustable through the pivot position to alter the braking force applied for any particular position of the pulley 22. The ribbon is flexible out of its plane and extends around the part circular surface 48 of the release actuator, the ribbon being secured at its other end 68 to the actuator surface (FIG. 4).

The operating means also has means to move the pads towards each other and apply a braking force to the disc 28. This comprises a brake application tension spring 70 operatively connected to the two brake arms to bias the arms towards each other. The mode of connection is by way of a brake application lever 72 which extends alongside arm 36 and is pivotally connected to arm 36 and link 52 at pivotal positions 56 and 60 so as to pivot together with the lever 58. Spring 70 joins the free end of lever 72 with a spring mounting pin 74 on the arm 38 intermediate pivotal position 54 and the arm connection point 40.

Biasing means is provided to urge the pulley in an anticlockwise direction as viewed in FIGS. 3 and 4. This biasing means comprises a material tensioning spring 76 one end of which is connected to the release arm and the other end is connected to one end of an adjustment arm 78 forming part of a means to adjust the location of the normal release arm position. A bow shaped member 80 extends downwardly from top to bottom of the cradle (FIG. 2) for each half reel shaft, the two members being diametrically opposed across the support pedestal. The top end of each member 80 carries the adjusting means for the location of the release arm. As shown by FIGS. 3 and 4, the adjustment arm 78 is pivotted at its other end 82 to the member 80 and intermediate the ends, a rotatable nut member 84 is mounted upon the arm. The nut member 84 forms part of a means to alter the pivotal position of the arm 78, this means also comprising a screw 86 received in screw-threaded engagement through the nut member. Tension in the spring 76 holds a head 88 of screw 86 against an abutment formed by a top surface 90 of the member 80. As may be seen, rotation of the screw 86 causes the arm 78 to pivot about its ends 82 by movement of the nut member 84 along the screw under the tension of spring 76 thereby to adjust the spring tension and thus the tension upon the length of conductor being fed around the pulley 22.

Before use of the cradle, each spring 76 urges its arm 24 and pulley 22 anticlockwise as viewed in FIGS. 3 and 4, thus causing the ribbon 62 to move downwards around the actuator surface 48 towards the link 52. This action removes any pull by the ribbon upon the lever 58 and the lever and link are pivotted about their pivotal positions by the action of spring 70 upon lever 72 and arm 38 to cause the arms 36 and 38 to close together. The brake pads are thus applied against the brake disc to prevent rotation of the respective reel shaft 14. This is the normal position as shown by FIG. 6.

When in use, the length 18 of conductor is passed from its respective half reel, around the pulley 20 and 22 as described above with reference to FIG. 1. As the length 18 is pulled through the cradle, tension in the length causes the pulley 22 and thus its release arm and actuator 46 to rotate clockwise in FIGS. 3 and 4 against the action of spring 76. This action causes the ribbon 62 to be pulled around the outer surface 48 of the actuator thereby raising the lever 58 as viewed in FIG. 6. Action upon link 58 in this way simultaneously moves the lever 72 and link 52 to move the brake arms 36 and 38 and thus the brake pads apart to reduce the braking pressure upon the disc. As shown by FIG. 7, the position of the arms and levers and link 52 with the brake fully released is shown.

As may be seen, any change in the tension produced in length 18 operates accordingly upon spring 76 and the ribbon 62 against spring 70 to open the brake discs only sufficiently to reduce the brake force to ensure an increased reduction in resistance to reel shaft rotation to return the tension within predetermined limits. Of course, any reduction in tension in the length 18 causes the braking force to be accordingly increased again to increase the tension to within its required limits. Hence, the tensioning device provides the required function of maintaining the tension substantially constant.

Further, the opposing forces applied by the springs 70 and 76 on one hand and the pull of ribbon 62 on the other hand when the pulley 22 is urged downwards under tension of the length 18 ensures a positive control over the positions of the brake pads both in the braking and release directions. It is also worthy of mention that the ribbon 62 is stiff in the direction of the ribbon plane whereby when the arms 36, 38 are opened, the ribbon serves as a centralizing medium to ensure that the two pads are applied with substantially equal force to the brake disc. A positive braking and release action thus results.

With the cradle according to the invention and as described in the first embodiment, the inertial forces are extremely low and moments of inertia such as are encountered with the torsion spring and helically tracked bearings of the conventional constructions are avoided. Also, the construction avoids the axially slidable break component construction which created serious wear problems with the conventional constructions.

What is claimed is:

1. A cradle for a twisting machine for filamentary material comprising:

a reel shaft for a half reel of filamentary material and rotatably mounted upon a support; and a tensioning device for the material, the tensioning device comprising: a brake disc coaxial with and rotatable together with the reel shaft and axially immovable relative to the shaft; two opposed brake pads disposed one on each side of the disc and located in position radially outwards on one side of the axis of the reel shaft;

a rotatable tensioning pulley having biasing means to urge the pulley with its rotational axis in one direction of movement and being movable in an opposite direction by a force acting against the biasing means; and a brake activator comprising:

(a) two brake arms extending one on each side of the brake disc, and the pads mounted one upon each of the arms, the arms being pivotally movable towards and away from one another to move the pads towards one another to apply or increase a braking force upon the disc and away from one another to reduce or cancel the braking force;

(b) a brake operating means comprising a brake release linkage extending across the plane of and outwardly from the disc, the linkage pivotally connected to the two brake arms at two pivotal positions and actuable to move said pivotal positions and the brake arms towards each other and away from one another; and (c) a brake release connector positively connected to the brake release linkage and to the pulley to activate the linkage, when the pulley moves in said opposite directions, to move the said pivotal positions and the brake arms controllably away from one another and to activate the linkage, when the pulley moves in said one direction, to cause said pivotal positions and the brake arms to move controllably towards one another.

2. A cradle according to claim 1, wherein said linkage comprises a link extending from one of the two pivotal positions across the plane of and outwardly from the brake disc, the link being pivotally attached to an actuating lever of the brake operating means, the actuating lever being operable by the brake release connector and attached to a brake arm at the other pivotal position.

3. A cradle according to claim 1, wherein the brake operating means comprises a brake release actuator pivotally mounted upon the support concentrically with the reel shaft, and said brake release actuator being operable connected to the pulley to pivotally move with the pulley in said one direction or in said opposite direction, and said brake release actuator having an outer arcuate surface which lies on a circular path concentric with the reel shaft, the brake release connector being flexible and extending from the brake release linkage, around the outer arcuate surface and being connected to the relase actuator, rotational movement of the brake release actuator in its opposite direction causing the brake release connector to wrap around the brake release actuator and actuate the linkage and move the brake arms away from one another.

4. A cradle according to claim 2, wherein the brake operating means comprises a brake release actuator pivotally mounted upon the support concentrically with the reel shaft, said brake release actuator being operable connected to the pulley to pivotally move with the pulley in said one direction or in said opposite direction, and said brake release actuator having an outer arcuate surface which lies on a circular path concentric with the reel shaft, the brake release connector being flexible and extending from the actuating lever around the outer arcuate surface and being connected to the release actuator, rotational movement of the brake release actuator in its opposite direction causing the brake release connector to wrap around the brake release actuator and actuate the linkage and move the brake arms away from one another.

5. A cradle according to either claim 3 or claim 4, wherein the brake release connector comprises a metal ribbon which is flexible in directions out of the plane of the ribbon while being stiff in the plane of the ribbon.

6. A cradle according to either claim 3 or claim 4, wherein the brake release connector comprises a high tensile steel ribbon which is flexible in directions out of the plane of the ribbon while being stiff in the plane of the ribbon.

7. A cradle according to either claim 3 or claim 4, wherein the brake release actuator has a release arm extending outwardly from the axis of the reel shaft and the pulley is rotatably mounted upon the release arm, movement of the pulley in one direction or the opposite direction being pivotally around the axis of the reel shaft together with pivotal movement of the release actuator and release arm.

8. A cradle according to either claim 3 or claim 4, wherein the brake release actuator has a release arm extending outwardly from the axis of the reel shaft and the pulley is rotatably mounted upon the release arm, movement of the pulley in one direction or the opposite direction being pivotally around the axis of the reel shaft together with pivotal movement of the release actuator and release arm, and said biasing means comprises a material tensioning spring operatively connected to the release arm to bias the arm, the release actuator and the pulley in said one direction.

9. The cradle according to claim 1, wherein the brake operating means comprises a brake application tension spring operatively connected to the two brake arms to bias the arms and the pads towards each other.

10. A cradle according to claim 1, wherein the brake operating means comprises a brake application tension spring operatively connected to the two brake arms to bias the arms towards one another, operation of the brake release connector to move the brake arms away from one another acting against the urgency of the brake application spring which operates to move the arms towards each other upon movement of the pulley in said one direction.

11. A cradle according to claim 9 or 10, wherein one end of the brake application spring is attached to a brake application link which is interconnected with the two arms to cause the brake application spring to stretch at a rate exceeding the rate of movement apart of the two pads.

12. A cradle according to claim 8, wherein the release arm has a normal position into which it is biased by the material tensioning spring when no force is applied against the tensioning spring to move the pulley wheel in said opposite direction, and means is provided to adjust the location of the normal position of the arm.

13. A cradle according to claim 12, wherein the adjusting means comprises an adjustment arm to which one end of the material tensioning spring is attached, the adjustment arm being pivotally connected to an arm support, and means to alter the pivotal position of the arm upon the arm support.

14. A cradle according to claim 13, wherein the means to alter the pivotal position of the arm comprises a screw in screw threaded engagement with a nut member pivotally mounted upon the adjustment arm, the screw being held against an abutment by the material tensioning spring and change in the screw position in the nut member pivotally moving the adjustment arm toward or away from the abutment to change the position of said one end of the tensioning spring.

* * * * *